US009298138B2

(12) United States Patent
Ishizuka

(10) Patent No.: US 9,298,138 B2
(45) Date of Patent: Mar. 29, 2016

(54) RECORDING APPARATUS WITH CLEANING UNIT FOR TRANSFER BELT

(71) Applicant: SEIKO EPSON CORPORATION, Tokyo (JP)

(72) Inventor: Hirotaka Ishizuka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/547,739

(22) Filed: Nov. 19, 2014

(65) Prior Publication Data

US 2015/0153684 A1 Jun. 4, 2015

(30) Foreign Application Priority Data

Nov. 29, 2013 (JP) ..... 2013-247386

(51) Int. Cl.
*G03G 15/16* (2006.01)
*B41J 11/00* (2006.01)
*B41J 29/17* (2006.01)

(52) U.S. Cl.
CPC ..... *G03G 15/161* (2013.01); *B41J 11/007* (2013.01); *B41J 29/17* (2013.01); *G03G 2215/1661* (2013.01)

(58) Field of Classification Search
CPC ..... G03G 15/161; G03G 21/0011; G03G 21/0029; G03G 2215/1647; G03G 2215/1661; G03G 2221/0084; B41J 11/007; B41J 29/17
USPC ..... 399/101, 350, 351, 348
See application file for complete search history.

(56) References Cited

U.S. PATENT DOCUMENTS

| | | | | |
|---|---|---|---|---|
| 4,083,633 | A * | 4/1978 | Shanly | 399/351 |
| 4,247,196 | A * | 1/1981 | Ogawa et al. | 399/351 |
| 4,866,483 | A * | 9/1989 | Davis et al. | 399/350 X |
| 4,939,551 | A * | 7/1990 | Hashiyama et al. | 399/351 |
| 7,127,201 | B2 * | 10/2006 | Takenouchi et al. | 399/101 X |
| 7,983,608 | B2 * | 7/2011 | Sugiyama | 399/351 |
| 2006/0291928 | A1 * | 12/2006 | Lee | 399/350 |
| 2012/0301176 | A1 | 11/2012 | Ferrar et al. | |

FOREIGN PATENT DOCUMENTS

| | | |
|---|---|---|
| EP | 1918115 A2 | 5/2008 |
| JP | 2012-116619 A | 6/2012 |

OTHER PUBLICATIONS

Extended European Search Report for European Patent Application No. 14195031.1 dated Mar. 24, 2015.

* cited by examiner

*Primary Examiner* — Sophia S Chen
(74) *Attorney, Agent, or Firm* — Global IP Counselors, LLP

(57) ABSTRACT

A recording apparatus includes a transfer belt which transfers a recording medium, a recording section which performs recording on the recording medium, and a wiper blade which is able to abut with the transfer belt, wherein the wiper blade is supported in a state of being clamped by clamping members. Extension lengths of the clamping members, which are from an clamping region in the direction toward the transfer belt, are different depending on the clamping member. The extension length of the clamping member, which is on the downstream side in the movement direction of the transfer belt to transfer the recording medium during recording, is longer.

9 Claims, 11 Drawing Sheets

RECORDING APPARATUS WITH CLEANING UNIT FOR TRANSFER BELT

CROSS-REFERENCE TO RELATED APPLICATIONS

This application claims priority to Japanese Patent Application No. 2013-247386 filed on Nov. 29, 2013. The entire disclosure of Japanese Patent Application No. 2013-247386 is hereby incorporated herein by reference.

BACKGROUND

1. Technical Field

The present invention relates to a recording apparatus.

2. Related Art

In the prior art, a recording apparatus is used which is provided with a transfer belt which supports and transfers a recording medium. Among these, a recording apparatus is disclosed where cleaning of the transfer belt is possible.

For example, a recording apparatus is disclosed in Japanese Unexamined Patent Application Publication No. 2012-116619 which is provided with a plurality of blades and a brush roller which attaches cleaning fluid to the transfer belt.

SUMMARY

However, in the recording apparatus where the transfer belt is cleaned by attaching cleaning fluid as disclosed in Japanese Unexamined Patent Application Publication No. 2012-116619, cleaning fluid remains on the transfer belt and the recording medium is unclean due to the cleaning fluid.

In addition, there are times when, in the recording apparatus, the transfer belt is moved in the opposite direction to the movement direction of the transfer belt to accompany transfer of the recording medium during recording. Then, due to the configuration of a contact portion of the transfer belt and a wiper blade which removes cleaning fluid which is attached to the transfer belt, there are cases where there is remarkable wear on the transfer belt and the wiper blade when the transfer belt is moved in the opposite direction.

Therefore, the object of the present invention is a recording apparatus where a transfer belt is cleaned by attaching cleaning fluid such that wear on the transfer belt and a wiper blade, which removes the cleaning fluid which is attached to the transfer belt, is suppressed when the transfer belt is moved in the opposite direction to the movement direction of the transfer belt to accompany transfer of the recording medium during recording.

A recording apparatus of a first aspect of the present invention for solving the problem described above is provided with: a transfer belt configured and arranged to transfer a recording medium; a recording section configured and arranged to perform recording on the recording medium; a wiper blade configured and arranged to abut with the transfer belt; and a pair of clamping members supporting the wiper blade as being clamped by the clamping members, an extension length from an clamping region toward the transfer belt of one of the clamping members on a downstream side with respect to a movement direction of the transfer belt transferring the recording medium during recording being longer than the extension length of the other of the clamping members.

According to the present aspect, the extension lengths of the clamping members from the clamping region in the direction of the transfer belt are different depending on the clamping member, and the extension length of the clamping member, which is on the downstream side in the movement direction of the transfer belt to accompany transfer of the recording medium during recording, is longer. As a result, when the transfer belt is moved in the opposite direction to the movement direction, it is possible for the wiper blade to be supported in a state where a leading edge section is curved at the origin due to the clamping member on the upstream side and it is possible to reduce wear on the transfer belt and the wiper blade by suppressing friction between the transfer belt and the wiper blade.

A recording apparatus of a second aspect of the present invention is the first aspect where the clamping members have rigidity equal to or more than the wiper blade.

According to the present aspect, the clamping members have rigidity which is equal to or more than the wiper blade. As a result, it is possible to reliably support the wiper blade.

A recording apparatus of a third aspect of the present invention is the first or the second aspect where the clamping members are elastic members.

According to the present aspect, the clamping members are elastic members. As a result, when the transfer belt is moved in the opposite direction to the movement direction, it is possible for the wiper blade to be supported in a state of being particularly curved due to the clamping members and it is possible to particularly reduce friction on the transfer belt and the wiper blade.

A recording apparatus of a fourth aspect of the present invention is any one of the first to the third aspects which is further provided with an additional wiper blade, and an additional pair of clamping members supporting the additional wiper blade as being clamped by the additional clamping members.

According to the present aspect, since a plurality of the wiper blades are provided, it is possible to effectively move the cleaning fluid from a support surface using the wiper blades and it is possible to effectively suppress the cleaning fluid remaining on the transfer belt and the recording medium being unclean due to the cleaning fluid.

Here, "provided with the plurality of wiper blades which are clamped by the clamping members" has the meaning that it is sufficient if at least one of the plurality of wiper blades is clamped by the clamping members that are arranged such that "the extension length of the clamping member which is on the downstream side in the movement direction is longer".

A recording apparatus of a fifth aspect of the present invention is any one of the first to the fourth aspects where, when the transfer belt is moved in an opposite direction to the movement direction, the wiper blade bends with the other of the clamping members on an upstream side as an origin.

According to the present aspect, when the transfer belt is moved in the opposite direction to the movement direction, the wiper blade is curved (bends) with the clamping member as the origin. Since the gap between the clamping member on the upstream side and the support surface is bigger than the gap between the clamping member on the downstream side and the support surface, it is possible for the wiper blade to be supported in a state where a leading edge section is curved more with the clamping member as the origin and it is possible to suppress wear on the transfer belt and the wiper blade when the transfer belt is moved in the opposite direction to the movement direction.

A recording apparatus of a sixth aspect of the present invention is any one of the first to the fifth aspects where the transfer belt includes a support surface on which the recording medium is supported, and the wiper blade is more hydrophilic than the support surface.

According to the present aspect, the wiper blade, which removes the cleaning fluid which is attached to the transfer belt, is more hydrophilic than the support surface. Since water or an aqueous solution is typically used as cleaning fluid, it is easier for the cleaning fluid to wet the wiper blade than the support surface, and it is possible for the cleaning fluid to be moved from the support surface to the wiper blades. That is, it is possible to effectively suppress the cleaning fluid remaining on the transfer belt and the recording medium being unclean due to the cleaning fluid.

A recording apparatus of a seventh aspect of the present invention is any one of the first to the sixth aspects where the clamping members clamp the wiper blade including a plurality of blades.

According to the present aspect, the clamping members clamp the wiper blade including a plurality of blades. As a result, it is possible for the rigidity of the entirety of the wiper blades which are clamped to be higher. That is, when the transfer belt is moved in the movement direction, it is possible for the wiper blades to reliably come into contact with the transfer belt and it is possible to effectively suppress the cleaning fluid remaining on the transfer belt and the recording medium being unclean due to the cleaning fluid.

A recording apparatus of an eighth aspect of the present invention is one of the first to the seventh aspects where at least one of the clamping members has a groove on a side facing the wiper blade.

According to the present aspect, at least one of the downstream side clamping member and the upstream side clamping member has a groove on the wiper blade side. As a result, it is possible to quickly move the cleaning fluid from the wiper blades by moving the cleaning fluid using a capillary phenomenon. Accordingly, it is possible to further improve the effective removing of the cleaning fluid which is attached to the transfer belt using the wiper blades.

A recording apparatus of a ninth aspect of the present invention is the seventh aspect where the plurality of blades includes an upstream side wiper blade on an upstream side and a downstream side wiper blade on the downstream side, and the downstream side wiper blade is arranged with respect to the upstream side wiper blade to be spaced with a gap which is equal to or more than a length of the upstream side wiper blade in the movement direction when the transfer belt is moved in the movement direction.

In the recording apparatus which is provided with the plurality of wiper blades, there are cases where the upstream side wiper blade is curved in the movement direction due to the upstream side wiper blade coming into contact with the support surface when the transfer belt is moved in the movement direction. In this case, there are cases when the transfer belt is stopped where the cleaning fluid remains in a region on the support surface which is equivalent to the length of the downstream side wiper blade in the movement direction. If the cleaning fluid remains in this region on the support surface, the cleaning fluid which remains in this region may not be removed by the upstream side wiper blade even if movement of the transfer belt is resumed.

However, according to the present aspect, the downstream side wiper blade is provided with regard to the upstream side wiper blade to be spaced with a gap equal to or more than the length of the region in the movement direction. As a result, it is possible to remove the cleaning fluid using the downstream side wiper blade when the movement of the transfer belt is resumed even though cleaning fluid remains in this region on the support surface when the transfer belt is stopped. Accordingly, it is possible to effectively suppress the cleaning fluid remaining on the transfer belt and the recording medium being unclean due to the cleaning fluid.

A recording apparatus of a tenth aspect of the present invention is provided with: a transfer belt configured and arranged to support and transfer a recording medium on a support surface; and a wiper blade configured and arranged to abut with the transfer belt, the wiper blade being configured to bend more when the transfer belt is moved in an opposite direction to a movement direction than when the transfer belt is moved in the movement direction to transfer the recording medium during recording.

According to the present aspect, the wiper blade is curved more when the transfer belt is moved in the opposite direction to the movement direction than when the transfer belt is moved in the movement direction to accompany transfer of the recording medium during transfer. As a result, when the transfer belt is moved in the opposite direction to the movement direction, it is possible to suppress wear on the transfer belt and the wiper blade by reducing friction on the transfer belt and the wiper blade by the wiper blade coming into contact with the transfer belt in a state of being curved more.

BRIEF DESCRIPTION OF THE DRAWINGS

Referring now to the attached drawings which form a part of this original disclosure.

DETAILED DESCRIPTION OF EXEMPLARY EMBODIMENTS

A recording apparatus according to embodiments of the present invention will be described below in detail with reference to the attached drawings.

First Embodiment (FIG. 1 to FIG. 8)

Figure 1:
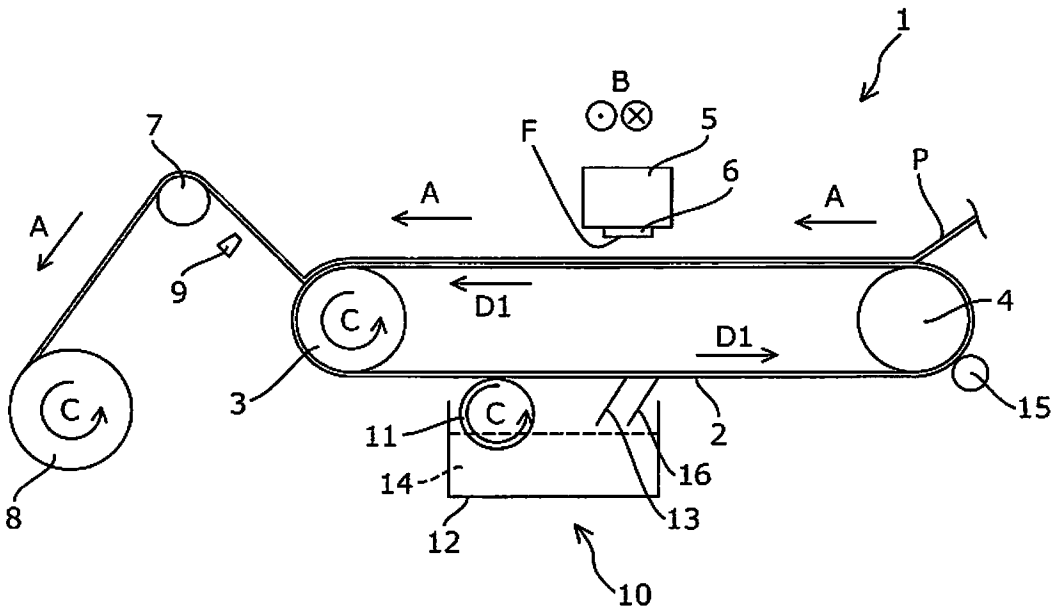
FIG. 1 is an outline diagram representing a side surface of a recording apparatus according to the first embodiment of the present invention.

FIG. 1 is an outline diagram representing a side surface of a recording apparatus 1 according to the first embodiment of the present invention.

The recording apparatus 1 of the present embodiment is provided with a transfer belt 2 which stretches between a driving roller 3 and a driven roller 4, which rotate in a rotation direction C, and which supports and transfers a recording medium P in a transfer direction A. The recording apparatus 1 of the present embodiment is provided with two rollers of the driving roller 3 and the driven roller 4 as a plurality of rotating bodies, but may be provided with three or more rollers, and a plurality among the rotating bodies may be driving rollers.

The transfer belt 2 of the present embodiment is moved in a movement direction D1 during recording by the driving roller 3 being rotated in the rotation direction C, and the recording medium P is transferred in the transfer direction A. In addition, it is possible to move the transfer belt 2 of the present embodiment in an opposite direction D2 which is the opposite direction to the movement direction D1 by the driving roller 3 being rotated in the opposite direction to the rotation direction C (refer to FIG. 4).

Here, the transfer belt 2 of the present embodiment is an adhesive belt which is coated with adhesive and which holds the recording medium P, by adhering so that the recording medium is able to be peeled away, on a surface on which the recording medium P is supported. However, the transfer belt 2 is not limited to this adhesive belt and may be a transfer belt which holds the recording medium P using electrostatic adhesion.

In addition, a recording head 6 is provided in a transfer path of the recording medium P using the transfer belt 2. The recording apparatus 1 forms a desired image by discharging ink from an ink discharge surface F of the recording head 6 onto a recording medium while the recording head 6 is moved back and forth in a direction B which intersects with the transfer direction A via a carriage 5.

Here, the recording apparatus 1 of the present embodiment is provided with the recording head 6 which records while being moved back and forth, but the recording apparatus 1 may be provided with a so-called line head where a plurality of nozzles which discharge ink are provided in a direction which intersects with the transfer direction A.

Here, the "line head" is a recording head which is provided so that it is possible for a region with the nozzles, which are formed in the direction B which intersects with the transfer direction A of the recording medium P, to cover the whole of the recording medium P in the direction B and which is used in a recording apparatus which forms an image by fixing either one out of the recording head or the recording medium P and moving the other one out of the recording head or the recording medium P. Here, the region with the nozzles in the line head in the direction B need not be able to cover the entirety of the recording medium P over all of the direction B which corresponds to the recording apparatus.

In the recording apparatus 1 of the present embodiment, the recording medium P is peeled away from the transfer belt 2 in a predetermined range and is wound using a winding section 8 via a driven roller 7 which is fixed at a predetermined position. Here, the winding section 8 rotates the recording medium P in the rotation direction C when the recording medium P is wound.

A sensor 9 which detects the peeling position of the recording medium P with regard to the transfer belt 2 is provided at a transfer passage of the recording medium P between a position where the recording medium P is peeled from the transfer belt 2 and a position where the driven roller 7 is provided.

Here, the sensor 9 is an optical sensor which irradiates light from a direction which intersects with the surface of the recording medium P and detects peeling of the recording medium P with regard to the transfer belt 2 using reflected light from the surface of the recording medium P.

As a result, detection precision is higher than, for example, a method in the prior art, using an optical sensor with a configuration where a reflecting section is provided at a side which opposes an irradiation section and reflected light is received by the reflecting section, so that peeling of the recording medium P with regard to the transfer belt 2 is detected by irradiating light from a direction along the surface of the recording medium P and detecting obstructing of the reflected light by the recording medium P. This is because the method in the prior art has detection errors due to the detection timing of the optical sensor and the timing whereby the reflected light is obstructed by the recording medium P being out of step since the length (thickness) of the recording medium P in the direction which intersects with the surface is short.

In addition, the recording apparatus 1 of the present embodiment is provided with a cleaning unit 10 as a cleaning section for cleaning the transfer belt 2. The cleaning unit 10 is provided with a cleaning brush 11, which is a contact section which comes into contact with the transfer belt 2 to attach cleaning fluid 14 which enters from a cleaning fluid tank 12, and wiper blades 13 and 16 (an upstream side wiper blade 13 and a downstream side wiper blade 16) which remove the cleaning fluid 14 which is attached to the transfer belt 2 by the cleaning brush 11 coming into contact with the transfer belt 2.

Here, the cleaning fluid 14 in the present embodiment is water, but is not limited to water and may be, for example, a cleaning fluid which contains a cleaning agent component.

In addition, the recording apparatus 1 of the present embodiment is provided with a towel roller 15 as a cloth roller, which aids removal of the cleaning fluid 14 which is attached to the transfer belt 2, at a position which opposes the driven roller 4 so as to interpose the transfer belt 2.

Here, "cloth roller" has the meaning of a roller which uses cloth in a contact section with the transfer belt 2.

Here, the towel roller 15 of the present embodiment is configured so that driven rotation is possible in the opposite direction to the rotation direction C to accompany movement of the transfer belt 2 in the direction D1, but the towel roller 15 is not limited to this configuration and, for example, may be configured to rotatably drive in the rotation direction C.

Next, the cleaning unit 10 of the recording apparatus 1 of the present embodiment will be described in detail.

Figure 2:
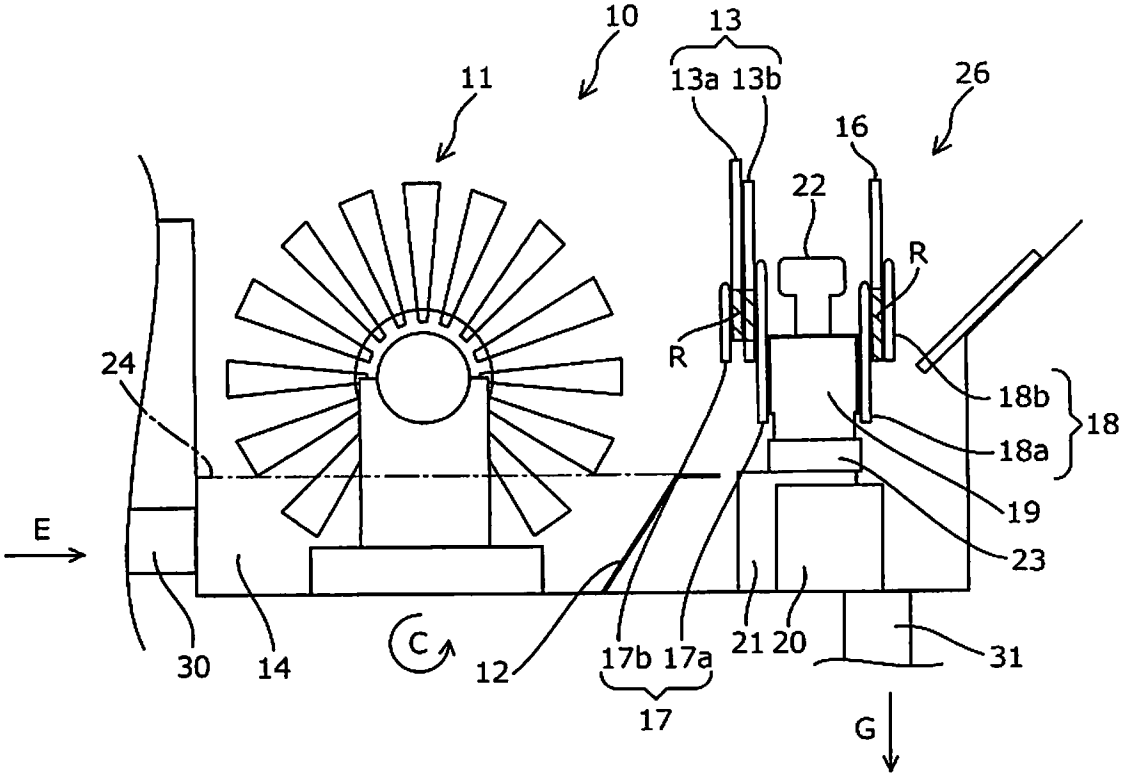
FIG. 2 is an outline diagram representing a side surface of a cleaning unit of the recording apparatus according to the first embodiment of the present invention.

FIG. 2 is an outline diagram representing a side surface of the cleaning unit 10 of the recording apparatus 1 of the present embodiment.

The cleaning fluid 14 is supplied from a supply pipe 30 to a cleaning fluid tank 12 in a direction E. Then, the cleaning fluid 14 which overflows from the cleaning fluid tank 12 is drained from a drainage pipe 31 in a direction G.

Here, the cleaning brush 11 is provided in the cleaning fluid tank 12, and a lower section of the cleaning brush 11 reaches to below a liquid surface 24 of the cleaning fluid 14. As a result, the cleaning fluid 14 which is attached to the cleaning brush 11 is attached to the transfer belt 2 by rotatably driving the cleaning brush 11 in the rotation direction C.

The upstream side wiper blade 13 is configured by two layers of wiper blades 13*a* and 13*b*, and the upstream side wiper blade 13 is clamped by clamping members 17 (a downstream side clamping member 17*a* and an upstream side clamping member 17*b*) which has the same or higher rigidity compared to the upstream side wiper blade 13. Then, the downstream side clamping member 17*a* is fixed to a wiper blade support base 19.

In addition, the downstream side wiper blade 16 is clamped by clamping members 18 (an upstream side clamping member 18*a* and a downstream side clamping member 18*b*) which has the same or higher rigidity compared to the downstream side wiper blade 16. Then, the upstream side clamping member 18*a* is fixed to the wiper blade support base 19. The upstream side wiper blade 13 and the downstream side wiper blade 16 may be the same member as the clamping members 17 or the clamping members 18.

It is possible for a metal material such as iron, steel, stainless steel, aluminum, or brass, or an elastic member such as silicone rubber, plasticized PVC rubber, urethane rubber, fluorine rubber, chloroprene rubber, nitrile rubber, ethylene propylene rubber, butyl rubber, and chlorosulfonated polyethylene rubber to be used for the clamping members 17 and the clamping members 18.

In addition, a region where the upstream side wiper blade 13 and the downstream side wiper blade 16 are clamped by the clamping members 17 and the clamping members 18 is represented as a clamping region R as represented in FIG. 2.

The wiper blade support base 19 is fixed to a wiper blade attaching section 20 via a stand 21, which is fixed using screws 27*a* and 27*b* (refer to FIG. 6) to the wiper blade attaching section 20, and a nut 23 using a bolt 22.

In this manner, the recording apparatus 1 of the present embodiment is configured with a wiper blade support section 26 using the clamping members 17, the clamping members 18, the wiper blade support base 19, the wiper blade attaching section 20, the stand 21, the bolt 22, the nut 23, and the like.

Here, FIG. 2 represents a state where the cleaning unit 10 is separated from the transfer belt 2. In this manner, in a state where the cleaning unit 10 is separated from the transfer belt 2, both the wiper blades 13 and 16 of the present embodiment extend in the vertical direction.

Next, a state, where the transfer belt 2 moves in the movement direction D1, and a state, where the transfer belt 2 moves in the opposite direction D2 to the movement direction D1, when the recording medium P is transferred in the transfer direction A in the recording apparatus 1 of the present embodiment during recording will be described.

Figure 3:
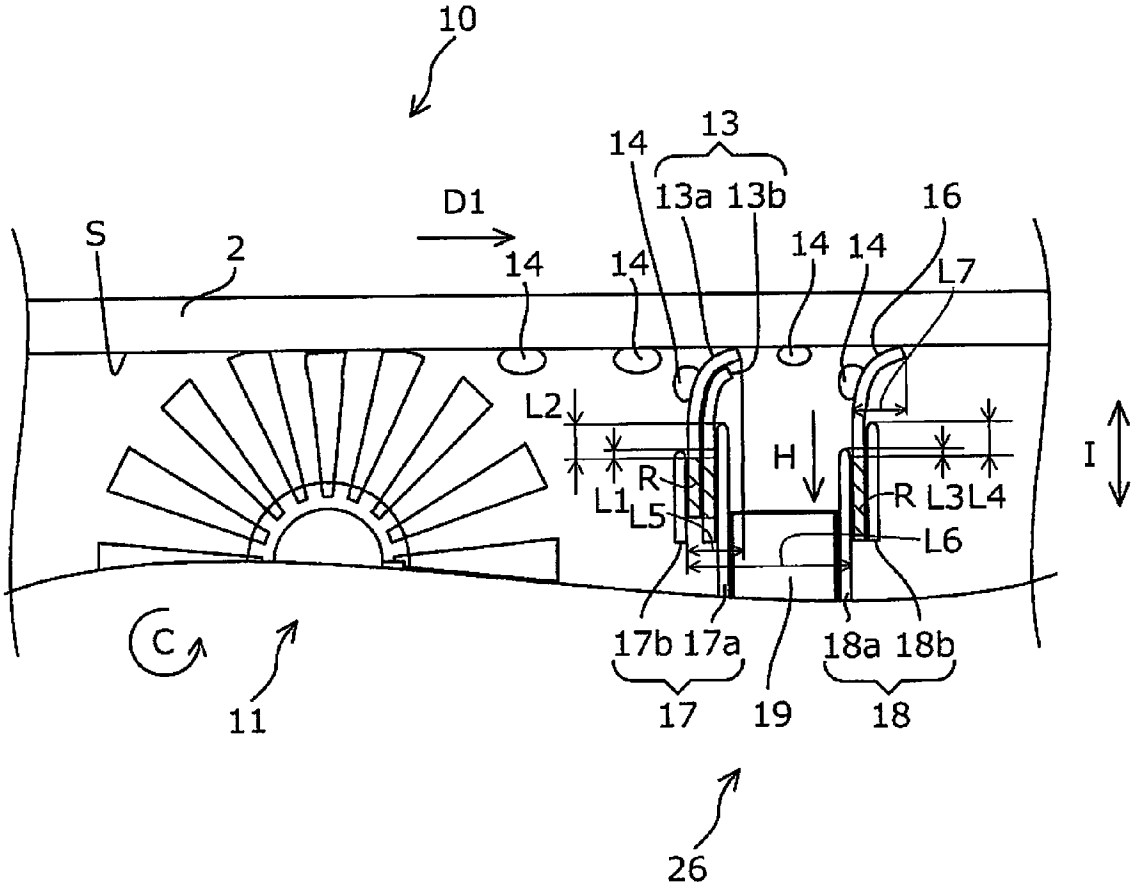
FIG. 3 is an outline diagram representing a side surface of the cleaning unit of the recording apparatus according to the first embodiment of the present invention and representing a state of the cleaning unit where a transfer belt moves in the movement direction when a recording medium is transferred during recording.

FIG. 3 is an outline diagram representing a side surface of the cleaning unit 10 of the recording apparatus 1 of the present embodiment and represents a state of the cleaning unit 10 where the transfer belt 2 moves in the movement direction D1 when the recording medium P is transferred during recording. Here, FIG. 3 is a state where the cleaning unit 10 cleans the transfer belt 2, and the cleaning brush 11 is rotatably driven in the rotation direction C.

Figure 4:
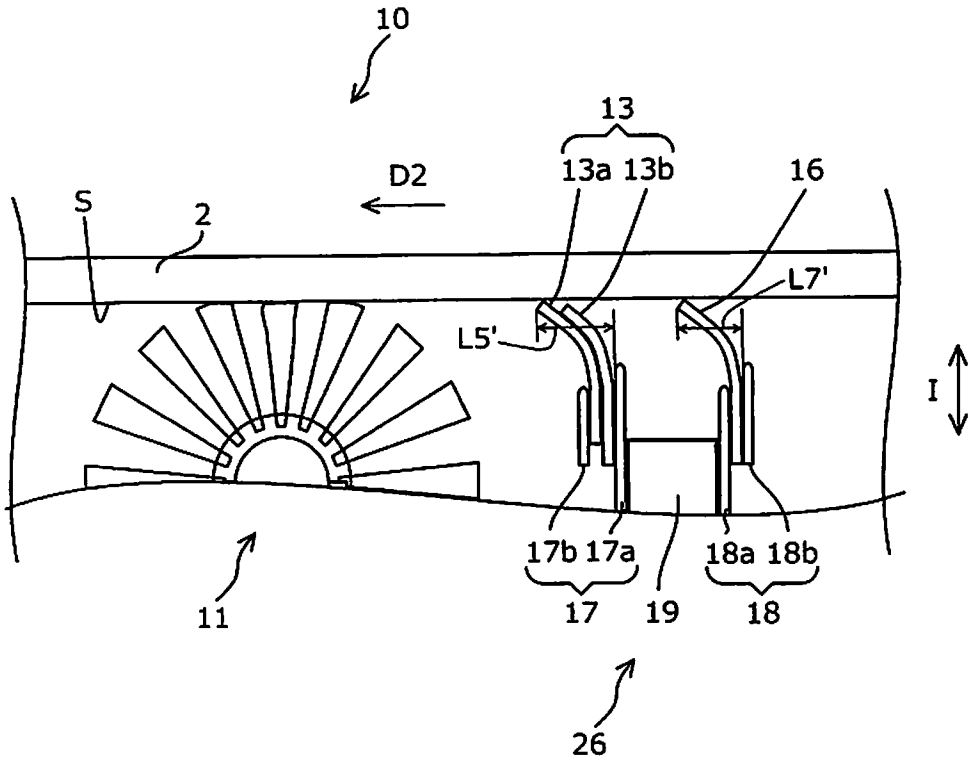
FIG. 4 is an outline diagram representing a side surface of the cleaning unit of the recording apparatus according to the first embodiment of the present invention and representing a state of the cleaning unit where the transfer belt moves in the opposite direction to the movement direction when a recording medium is transferred during recording.

In addition, FIG. 4 is an outline diagram representing a side surface of the cleaning unit 10 of the recording apparatus 1 of the present embodiment and represents a state of the cleaning unit 10 where the transfer belt 2 moves in the opposite direction D2 to the movement direction D1 when the recording medium P is transferred during recording. Here, in FIG. 4, driving of the cleaning brush 11 is stopped.

As represented in FIG. 3, in the state where the cleaning unit 10 cleans the transfer belt 2 (a state where the transfer belt 2 is moved in the movement direction D1), the cleaning fluid 14 is attached to a support surface S of the transfer belt 2 to accompany the cleaning brush 11 being rotatably driven in the rotation direction C. The recording apparatus 1 of the present embodiment removes the cleaning fluid 14, which is attached to the support surface S of the transfer belt 2, from the transfer belt 2 by the wiper blades 13 and 16 coming into contact with the support surface S of the transfer belt 2.

On the other hand, as represented in FIG. 4, driving of the cleaning brush 11 is stopped in the state where the transfer belt 2 moves in the opposite direction D2. In this manner, attaching of the cleaning fluid 14 to the support surface S of the transfer belt 2 by the cleaning brush 11 being rotatably driven is suppressed due to driving of the cleaning brush 11 being stopped when the transfer belt 2 moves in the opposite direction D2.

As described above, the recording apparatus 1 of the present embodiment is provided with the recording section (the recording head 6) which performs recording on the recording medium P, the transfer belt 2 which supports and transfers the recording medium P on the support surface S, and the cleaning unit 10 which has the cleaning brush 11, which comes into contact with the transfer belt 2 to attach the cleaning fluid 14, and the wiper blades 13 and 16 which remove the cleaning fluid 14 which is attached to the transfer belt 2.

Then, the wiper blades 13 and 16 are supported in a state of being clamped by the clamping members 17 and 18 from the upstream side and the downstream side in the movement direction D1 of the transfer belt 2 to accompany transfer of the recording medium P during recording. In addition, the extension lengths of the clamping members 17 (an extension length L1 of the upstream side clamping member 17*b* and an extension length L2 of the downstream side clamping member 17*a*), which are from the clamping region R in the direction of the transfer belt 2, are different depending on the clamping member 17, and the extension length L2 of the downstream side clamping member 17*a*, which is on the downstream side of the transfer belt 2 in the movement direction A to accompany transfer of the recording medium P during recording, is longer out of the extension lengths L1 and L2. Then, the extension lengths of the clamping members 18 (an extension length L3 of the upstream side clamping member 18*a* and an extension length L4 of the downstream side clamping member 18*b*), which are from the clamping region R in the direction of the transfer belt 2, are different depending on the clamping member 18, and the extension length L4 of the downstream side clamping member 18*b*, which is on the downstream side of the transfer belt 2 in the movement direction A to accompany transfer of the recording medium P during recording, is longer out of the extension lengths L3 and L4.

With this configuration, as represented by FIG. 3, it is possible for the recording apparatus 1 of the present embodiment to more reliably support the wiper blades 13 and 16 using the downstream side clamping members 17*a* and 18*b* when the transfer belt 2 is moved in the movement direction D1 and it is possible to suppress the cleaning fluid 14 remaining on the transfer belt 2.

In addition, as represented by FIG. 4, when the transfer belt 2 is moved in the opposite direction D2, it is possible for the recording apparatus 1 of the present embodiment to support the wiper blades 13 and 16 in a state of being curved with the upstream side clamping members 17*b* and 18*a* as the origin and it is possible to suppress wear on the transfer belt 2 and the wiper blades 13 and 16 by reducing the friction on the transfer belt 2 and the wiper blades 13 and 16.

That is, the recording apparatus 1 of the present embodiment suppresses the cleaning fluid 14 remaining on the transfer belt 2. Then, wear on the transfer belt 2 and the wiper blades 13 and 16 is suppressed when the transfer belt 2 is moved in the opposite direction D2.

In addition, as described above, there is a configuration where it is possible to reliably support the wiper blades 13 and 16 since the clamping members 17 and 18 have a rigidity of equal to or more than the wiper blades 13 and 16.

In addition, as described above, since the clamping members 17 and 18 of the present embodiment are elastic members, there is a configuration where, when the transfer belt 2 is moved in the opposite direction D2, it is possible for the wiper blades 13 and 16 to be supported in a state of being particularly curved due to the clamping members 17 and 18 and it is possible to particularly reduce friction on the transfer belt 2 and the wiper blades 13 and 16.

Using a different expression to above, the recording apparatus 1 of the present embodiment is provided with the transfer belt 2, which supports and transfers the recording medium P on the support surface S, and the wiper blades 13 and 16 which are able to abut the transfer belt 2.

Then, the wiper blades 13 and 16 are curved more when the transfer belt 2 is moved in the opposite direction D2 to the movement direction D1 than when the transfer belt 2 is moved in the movement direction D1 to accompany transfer of the recording medium P during recording.

In FIG. 3 and FIG. 4, a length L5' of the upstream side wiper blade 13 in the opposite direction D2 when the transfer belt 2 is moved in the opposite direction D2 is longer than a length L5 of the upstream side wiper blade 13 in the movement direction D1 when the transfer belt 2 is moved in the movement direction D1. In addition, a length L7' of the downstream side wiper blade 16 in the opposite direction D2 when the transfer belt 2 is moved in the opposite direction D2 is longer than the length L7 of the downstream side wiper blade 16 in the movement direction D1 when the transfer belt 2 is moved in the movement direction D1. That is, in the recording apparatus 1 of the present embodiment, the wiper blades 13 and 16 are curved more when the transfer belt 2 is moved in the opposite direction D2 than when the transfer belt 2 is moved in the movement direction D1.

As a result, when the transfer belt 2 is moved in the movement direction D1, it is possible to suppress the cleaning fluid 14 remaining on the transfer belt 2 by the wiper blades 13 and 16 reliably coming into contact with the transfer belt 2. In addition, due to the wiper blades 13 and 16 coming into contact with the transfer belt 2 in a state of being curved more when the transfer belt 2 is moved in the opposite direction D2, it is possible to suppress wear on the transfer belt 2 and the wiper blades 13 and 16 by reducing friction on the transfer belt 2 and the wiper blades 13 and 16.

That is, the cleaning fluid 14 remaining on the transfer belt 2 is suppressed. Then, wear on the transfer belt 2 and the wiper blades 13 and 16 is suppressed when the transfer belt 2 is moved in the opposite direction D2.

In addition, as described above, the recording apparatus 1 of the present embodiment is provided with the plurality of wiper blades of the wiper blade 13 which is clamped by the clamping members 17 and the wiper blade 16 which is clamped by the clamping members 18.

As a result, it is possible to effectively move the cleaning fluid 14 from the support surface S using the wiper blades 13 and 16, and it is possible to suppress the cleaning fluid 14 remaining on the transfer belt 2 and the recording medium P being unclean due to the cleaning fluid 14.

Here, in the recording apparatus 1 of the present embodiment, the extension lengths of the clamping members 17 and 18 on the downstream side in the movement direction D1 are longer for both of the wiper blades 13 and 16 which are clamped by the clamping members 17 and 18. However, the recording apparatus 1 of the present embodiment is not limited to this configuration, and it is sufficient if the extension lengths of the clamping members 17 and 18 on the downstream side in the movement direction D1 are longer in at least one of the plurality of wiper blades.

In addition, as described above, the recording apparatus 1 of the present embodiment is provided with the upstream side wiper blade 13 and the downstream side wiper blade 16 as the plurality of wiper blades.

Then, as represented by FIG. 3, the downstream side wiper blade 16 is arranged with regard to the upstream side wiper blade 13 to be spaced with a gap L6 which is equal to or more than the length L5 of the upstream side wiper blade 13 in the movement direction D1 when the transfer belt 2 is moved in the movement direction D1.

As in the recording apparatus 1 of the present embodiment, there are cases in the recording apparatus 1 which is provided with a plurality of the wiper blades where the upstream side wiper blade 13 is curved in the movement direction D1 by the upstream side wiper blade 13 coming into contact with the support surface S when the transfer belt 2 is moved in the movement direction D1. In this case, there are cases when the transfer belt 2 is stopped where the cleaning fluid 14 remains in a region on the support surface S which is equivalent to the length L5 of the upstream side wiper blade 13 in the movement direction A. If the cleaning fluid 14 remains in this region on the support surface S, there are times when the cleaning fluid 14 which remains in this region will not be removed by the upstream side wiper blade 13 even if movement of the transfer belt 2 is resumed.

However, in the recording apparatus 1 of the present embodiment, the downstream side wiper blade 16 is provided with regard to the upstream side wiper blade 13 to be spaced with a gap L6 which is equal to or more than the length L5 in the movement direction of the region. As a result, it is possible to remove the cleaning fluid 14 using the downstream side wiper blade 16 when the movement of the transfer belt 2 is resumed even if the cleaning fluid 14 remains in the region on the support surface S when the transfer belt 2 is stopped. Accordingly, the cleaning fluid 14 remaining on the transfer belt 2 and the recording medium P being unclean due to the cleaning fluid 14 are effectively suppressed.

In addition, as represented by FIG. 4, in the recording apparatus 1 of the present embodiment, the wiper blades 13 and 16 are curved with the upstream side clamping members 17*b* and 18*a* as the origin when the transfer belt 2 is moved in the opposite direction D2 to the movement direction D1.

As represented by FIG. 4, the gap between the upstream side clamping members 17*b* and 18*a* and the support surface S is larger than the gap between the downstream side clamping members 17*a* and 18*b* and the support surface S. As a result, in the recording apparatus 1 of the present embodiment, when the transfer belt 2 is moved in the opposite direction D2, the wiper blades 13 and 16 are supported in a state of being curved with the clamping members 17 and 18 as the origin and wear on the transfer belt 2 and the wiper blades 13 and 16 is suppressed.

Here, the wiper blades 13 and 16 are more hydrophilic than the support surface S. That is, in a case where the cleaning fluid 14 contains water, it is easier for the cleaning fluid 14 to wet the wiper blades 13 and 16 than to wet the support surface S. As a result, in the recording apparatus 1 of the present embodiment, it is possible to move the cleaning fluid 14 which is attached to the transfer belt 2 using the wiper blades 13 and 16. In this manner, the cleaning fluid 14 remaining on the transfer belt 2 and the recording medium P being unclean due to the cleaning fluid 14 are suppressed.

Furthermore, in the recording apparatus 1 of the present embodiment, it is possible to move the cleaning fluid 14 which is attached to the wiper blades 13 and 16 in a direction H which is the direction of gravity due to the weight the cleaning fluid 14 itself. Here, in the recording apparatus 1 of the present embodiment, since both of the wiper blades 13 and 16 are configured so as to extend in the vertical direction, it is easy to move the cleaning fluid 14 from the wiper blades 13 and 16 due to the weight the cleaning fluid 14 itself.

In addition, as described above, the clamping members 17 of the recording apparatus 1 of the present embodiment clamp a plurality of wiper blades of the wiper blades 13*a* and 13*b* which are the upstream side wiper blades 13.

In this manner, the rigidity of the entirety of the plurality of upstream side wiper blades 13 which are clamped is higher. That is, the upstream side wiper blades reliably come into contact with the transfer belt 2 when the transfer belt 2 is moved in the movement direction D1, and the cleaning fluid 14 remaining on the transfer belt 2 and the recording medium P being unclean due to the cleaning fluid 14 are effectively suppressed.

In addition, in the recording apparatus 1 of the present embodiment, the wiper blades 13*a*, 13*b*, and 16 are configured with the same material, and the upstream side wiper blade 13 is configured with two layers of the wiper blades 13*a* and 13*b*. Due to this configuration, the rigidity of the wiper blades 13 and 16, which are the plurality of wiper blades, are different.

In this manner, the wiper blades 13 and 16 come into contact with the support surface S in states which are different, and the cleaning fluid 14 is effectively moved from the support surface S using the wiper blades 13 and 16. As a result, the cleaning fluid 14 remaining on the transfer belt 2 and the recording medium P being unclean due to the cleaning fluid 14 are suppressed.

Here, the recording apparatus 1 of the present embodiment is not limited to this configuration, and for example, the respective rigidities of the plurality of wiper blades which have different rigidities may be different by using wiper blades with different materials as the plurality of wiper blades where the rigidities differ.

In addition, as represented by FIG. 3 and FIG. 4, there is a configuration where it is possible for the wiper blades 13 and 16 of the recording apparatus 1 of the present embodiment to move in a direction I where wiper blades 13 and 16 come closer and move away with regard to the support surface S and it is possible to change the contact area with regard to the support surface S.

That is, it is possible to change the contact area of the wiper blades 13 and 16 with regard to the support surface S by changing the position of the wiper blades 13 and 16 with regard to the support surface S while the wiper blades 13 and 16 come into contact with the support surface S. Accordingly, in a case where, for example, it is difficult to move the cleaning fluid 14 from the support surface S using the wiper blades 13 and 16, it is possible to increase the contact area of the wiper blades 13 and 16 with regard to the support surface S by pushing the wiper blades 13 and 16 onto the support surface S. As a result, it is possible to effectively move the cleaning fluid 14 from the support surface S using the wiper blades 13 and 16, and it is possible to suppress the cleaning fluid 14 remaining on the transfer belt 2 and the recording medium P being unclean due to the cleaning fluid 14.

Next, the positional relationship of the cleaning unit 10 with regard to the transfer belt 2 and the positional relationship of the wiper blade support section 26 with regard to the cleaning unit 10 will be described.

Figure 5:
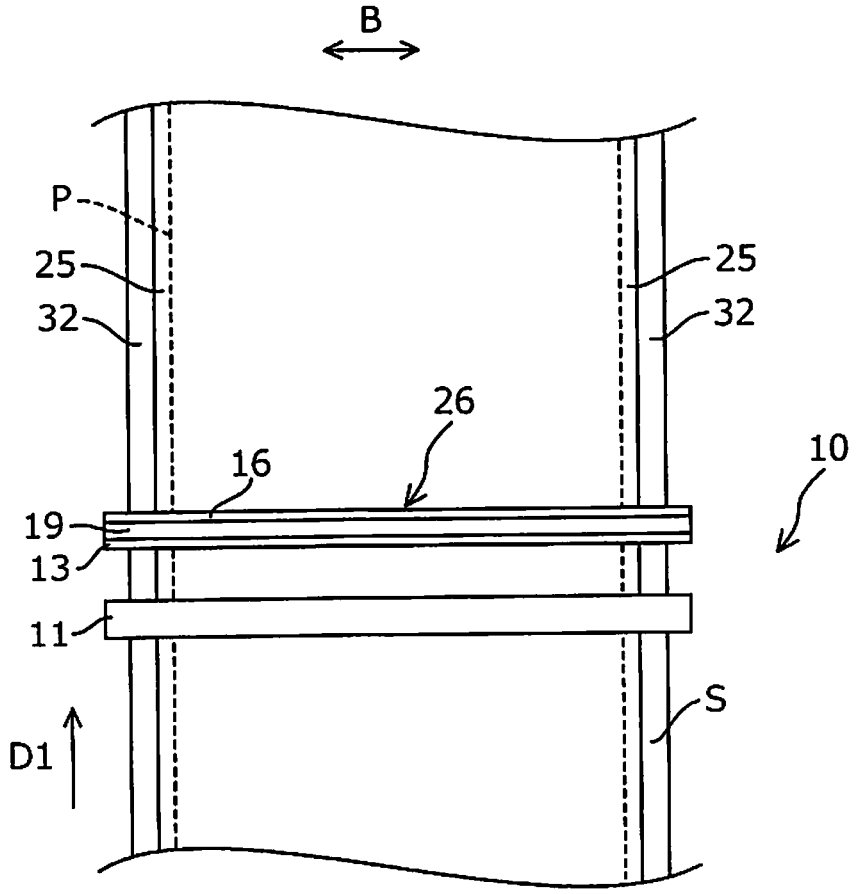
FIG. 5 is an outline diagram of a bottom surface representing a positional relationship between the transfer belt and the cleaning unit in the recording apparatus according to the first embodiment of the present invention.

FIG. 5 is an outline diagram of a bottom surface representing the positional relationship between the transfer belt 2 and the cleaning unit 10 in the recording apparatus 1 of the present embodiment and represents a state where the support surface S of the transfer belt 2 is viewed from below. Here, the recording medium P is not supported on the support surface S in the state in which the support surface S faces down. However, in order to describe the positional relationship with the support position (adhesion position) of the recording medium P at an adhesive surface 25 and a non-adhesive surface 32 on the support surface S, a dashed line in FIG. 5 indicates the support position of the recording medium P.

In the recording apparatus 1 of the present embodiment, the cleaning brush 11 and the wiper blades 13 and 16 are provided so as to exceed the width of the transfer belt 2 on both sides in the direction B which corresponds to the width direction of the transfer belt 2.

In addition, the wiper blade support section 26 is provided at a center section between the wiper blades 13 and 16 in the direction B. Due to this configuration, warping of the wiper blades 13 and 16 near the center section in the direction B, the wiper blades 13 and 16 not coming into contact with the transfer belt 2, and contact faults such as non-uniform contact are suppressed.

In addition, the support surface S of the transfer belt 2 of the present embodiment has the adhesive surface 25, on which the recording medium P is supported and which is covered by an adhesive agent over a wider range than the support position of the recording medium P in the direction B, and the non-adhesive surface 32, which is not covered by an adhesive agent, on both sides of the adhesive surface 25 in the direction B. Here, the non-adhesive surface 32 is more hydrophilic than the adhesive surface 25. Then, the wiper blades 13 and 16 are more hydrophilic than the non-adhesive surface 32.

In this manner, the transfer belt 2 of the present embodiment is a so-called adhesive belt which has the adhesive surface 25 on the support surface S. Since the transfer belt 2 of the present embodiment has this configuration, it is easy to move the cleaning fluid 14 from the adhesive surface 25, on which the recording medium P is supported, to the non-adhesive surface 32, and it is easy to move the cleaning fluid 14 from the adhesive surface 25 and non-adhesive surface 32 using the wiper blades 13 and 16. As a result, the cleaning fluid 14 remaining on the adhesive surface 25 of the transfer belt 2 and the recording medium P being unclean due to the cleaning fluid 14 are effectively suppressed.

Next, the wiper blade support section 26 will be described in detail.

Figure 6:
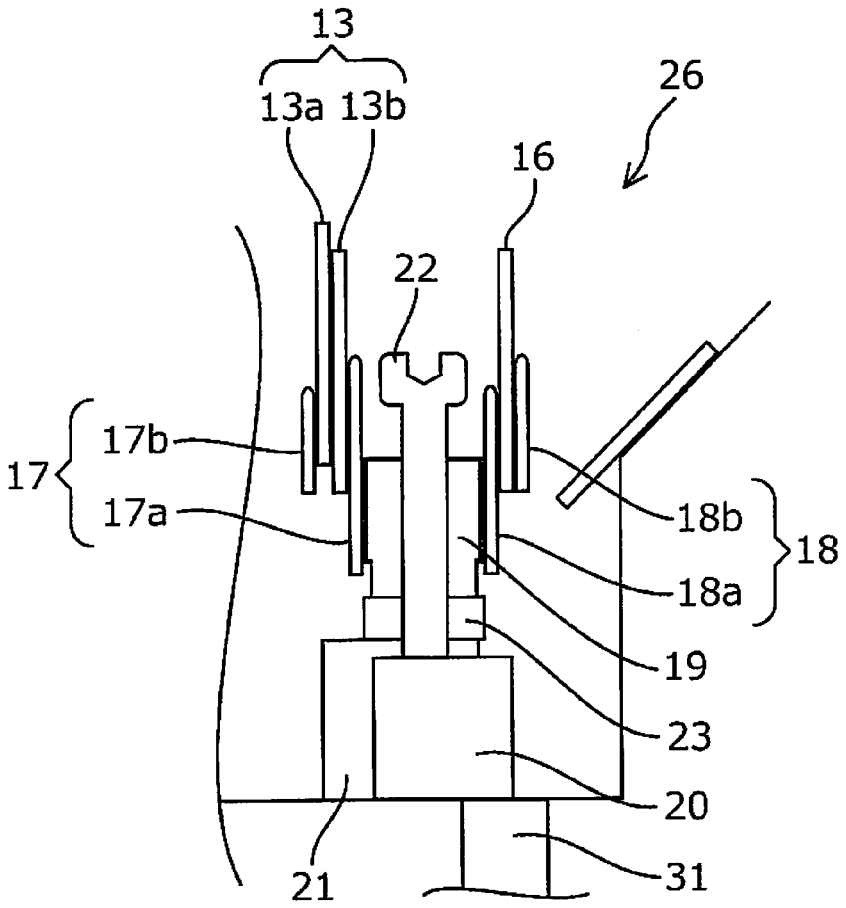
FIG. 6 is an outline diagram representing a side surface cross section of a wiper blade support section in the cleaning unit of the recording apparatus according to the first embodiment of the present invention.

FIG. 6 is an outline diagram representing a side surface cross section of the wiper blade support section 26 in the cleaning unit 10 of the recording apparatus 1 of the present embodiment. In addition, FIG. 7 is an outline diagram representing a front surface of the wiper blade support section 26 in the cleaning unit 10 of the recording apparatus 1 of the present embodiment.

As represented by FIG. 6, the wiper blade 13 is clamped by the clamping members 17*a* and 17*b*, and the clamping member 17*a* is fixed to the wiper blade support base 19. In addition, the wiper blade 16 is clamped by the clamping members 18*a* and 18*b*, and the clamping member 18*a* is fixed to the wiper blade support base 19. Then, the wiper blade support base 19 which is the center section adjusts the height on the wiper blade attaching section 20 via the stand 21 and the nut 23 by fastening the bolt 22 of the wiper blade attaching section 26 and is fixed using the screws 27*a* and 27*b* in the direction B which corresponds to the width direction of the transfer belt 2.

Figure 7:
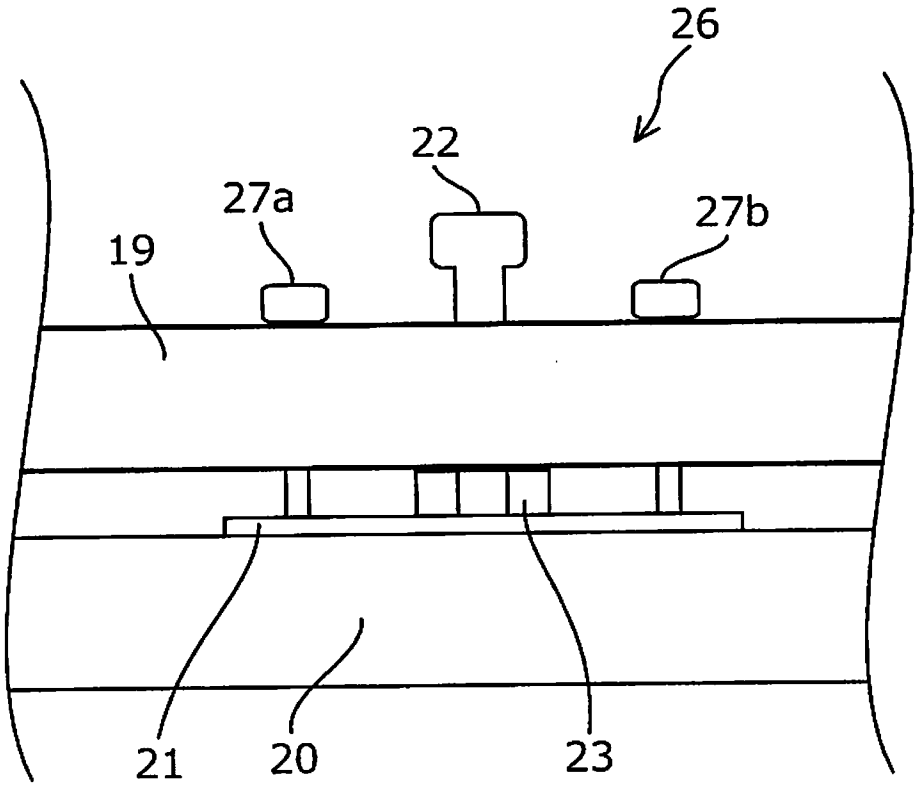
FIG. 7 is an outline diagram representing a front surface of a wiper blade support section in the cleaning unit of the recording apparatus according to the first embodiment of the present invention.

In addition, as represented by FIG. 7, the wiper blade support base 19 and the stand 21 are fixed using the screws 27*a* and 27*b*.

Due to this configuration, the wiper blade support section 26 fixes the wiper blades 13 and 16 to the wiper blade attaching section 20 of the cleaning unit 10.

Next, the clamping members 17 and 18 will be described in detail.

Figure 8:
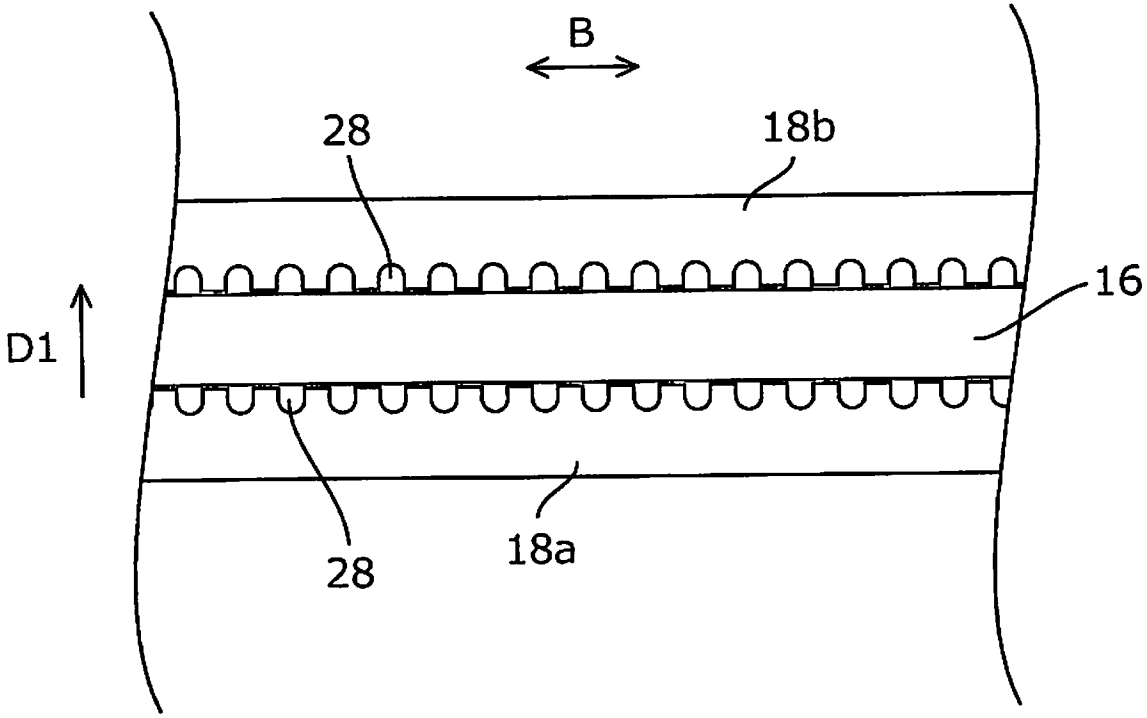
FIG. 8 is an outline diagram of a planar cross section of clamping members of wiper blades in the cleaning unit of the recording apparatus according to the first embodiment of the present invention.

FIG. 8 is an outline diagram of a planar cross section of the clamping members 18 (the upstream side clamping member 18*a* and the downstream side clamping member 18*b*) of the downstream side wiper blade 16 in the cleaning unit 10 of the recording apparatus 1 of the present embodiment.

Here, the clamping members 17 have the same configuration as the clamping members 18 except for interposing the wiper blades 13 with two layers instead of the wiper blade 16 with one layer.

As represented by FIG. 8, the upstream side clamping member 18*a* and the downstream side clamping member 18*b* are provided with a plurality of grooves 28 at the side where the downstream side wiper blade 16 is clamped.

Here, the upstream side clamping member 17*b* and the downstream side clamping member 17*a* in the clamping members 17 are provided with the plurality of grooves 28 at the side where the upstream side wiper blade 13 is clamped.

As in the recording apparatus 1 of the present embodiment, a configuration is preferable where at least one of the downstream side clamping member and the upstream side clamping member has the grooves 28 on the wiper blade side.

With this configuration, it is possible to quickly move the cleaning fluid 14 from the wiper blades 13 and 16 by moving the cleaning fluid 14 using a capillary phenomenon. Accordingly, it is possible to further improve the effective removing of the cleaning fluid 14 which is attached to the transfer belt 2 using the wiper blades 13 and 16.

Figure 9:
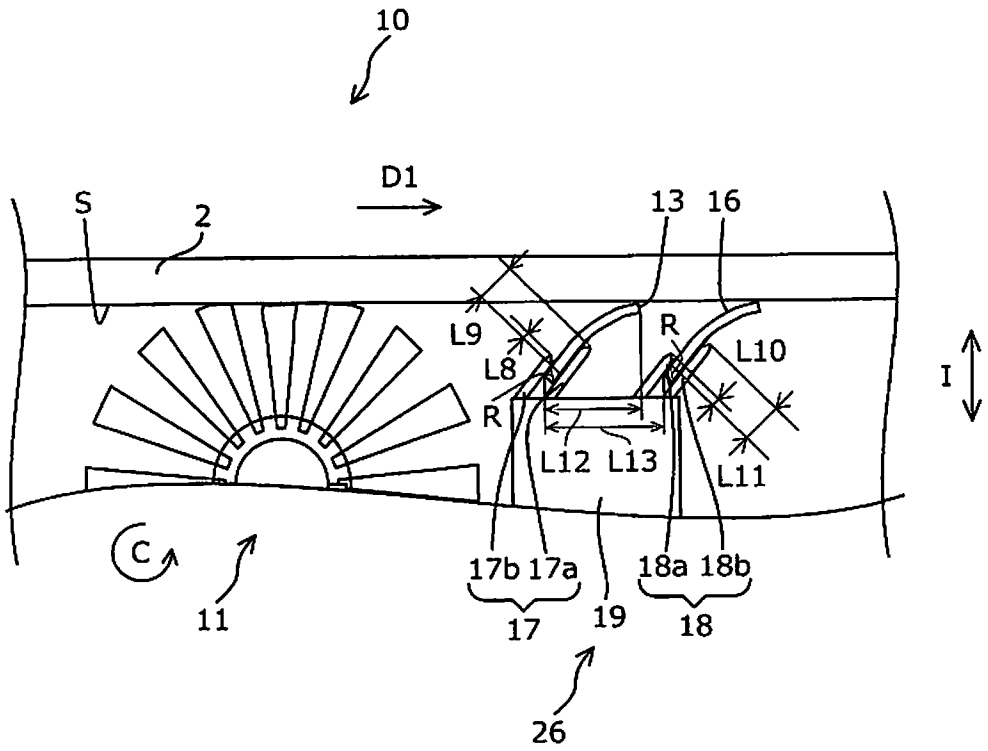
FIG. 9 is an outline diagram representing a side surface of a cleaning unit of a recording apparatus according to the second embodiment of the present invention and representing a state in which a transfer belt moves in a movement direction when a recording medium is transferred in the cleaning unit during recording.
Figure 10:
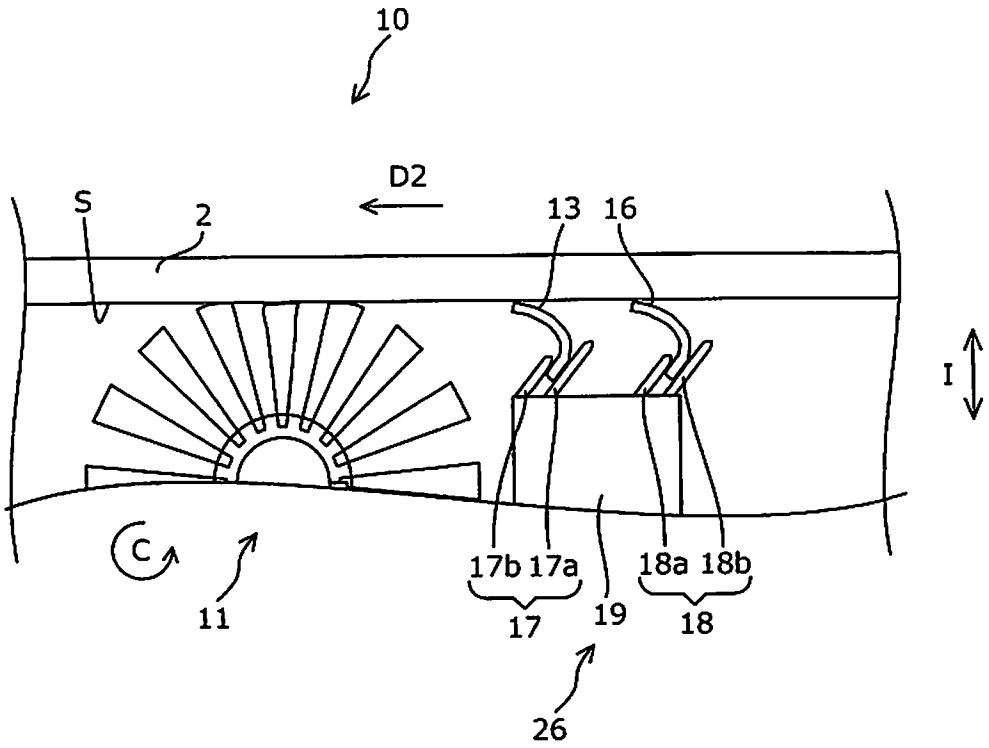
FIG. 10 is an outline diagram representing a side surface of the cleaning unit of the recording apparatus according to the second embodiment of the present invention and representing a state in which the transfer belt moves in the opposite direction to the movement direction when a recording medium is transferred in the cleaning unit during recording.

Second Embodiment (FIG. 9 and FIG. 10)

Next, a recording apparatus of the second embodiment will be described in detail with reference to the attached drawings.

FIG. 9 is an outline diagram representing a side surface of the cleaning unit 10 of the recording apparatus 1 of the present embodiment and representing a state of the cleaning unit 10 where the transfer belt 2 moves in the movement direction D1 when the recording medium P is transferred during recording. In addition, FIG. 10 is an outline diagram representing a side surface of the cleaning unit 10 of the recording apparatus 1 of the present embodiment and representing a state of the cleaning unit 10 where the transfer belt 2 moves in the opposite direction D2 to the movement direction D1 when the recording medium P is transferred during recording. Here, configuring members which are common with the embodiment described above are shown with the same symbols and detailed description thereof is omitted.

Here, the cleaning unit 10 of the present embodiment has the same configuration as the cleaning unit 10 of the first embodiment except for the wiper blade 13 being configured with one layer and the wiper blades 13 and 16 both extending to be inclined from the vertical direction.

Here, FIG. 9 represents a state where the cleaning unit 10 cleans the transfer belt 2, and the cleaning brush 11 is rotatably driven in the rotation direction C. In addition, in FIG. 10, driving of the cleaning brush 11 is stopped.

In the same manner as the recording apparatus of the first embodiment, the recording apparatus 1 of the present embodiment is provided with the recording section (the recording head 6) which performs recording on the recording medium P, the transfer belt 2 which supports and transfers the recording medium P on the support surface S, and the cleaning unit 10 which has the cleaning brush 11, which comes into contact with the transfer belt 2 to attach the cleaning fluid 14, and the wiper blades 13 and 16 which remove the cleaning fluid 14 which is attached to the transfer belt 2.

Then, the wiper blades 13 and 16 are supported in a state of being clamped by the clamping members 17 and 18 from the upstream side and the downstream side in the movement direction D1 of the transfer belt 2 to accompany transfer of the recording medium P during recording. In addition, the extension lengths of the clamping members 17 (an extension length L8 of the upstream side clamping member 17*b* and an extension length L9 of the downstream side clamping member 17*a*), which are from the clamping region R in the direction of the transfer belt 2, are different depending on the clamping member 17, and the extension length L9 of the downstream side clamping member 17*a*, which is on the downstream side of the transfer belt 2 in the movement direction A to accompany transfer of the recording medium P during recording, is longer out of the extension lengths L8 and L9. Then, the extension lengths of the clamping members 18 (an extension length L10 of the upstream side clamping member 18*a* and an extension length L11 of the downstream side clamping member 18*b*), which are from the clamping region R in the direction of the transfer belt 2, are different depending on the clamping member 18, and the extension length L11 of the downstream side clamping member 18*b*, which is on the downstream side of the transfer belt 2 in the movement direction A to accompany transfer of the recording medium P during recording, is longer out of the extension lengths L10 and L11.

In addition, as understood when comparing FIG. 9 and FIG. 10, in the recording apparatus 1 of the present embodiment, the wiper blades 13 and 16 are curved more when the transfer belt 2 is moved in the opposite direction D2 than when the transfer belt 2 is moved in the movement direction D1.

With this configuration, the recording apparatus 1 of the present embodiment suppresses the cleaning fluid 14 remaining on the transfer belt 2 and suppress wear on the transfer belt 2 and the wiper blades 13 and 16 when the transfer belt 2 is moved in the opposite direction D2 in the same manner as the recording apparatus 1 of the first embodiment.

In addition, in the same manner as the recording apparatus of the first embodiment, the recording apparatus 1 of the present embodiment is provided with the upstream side wiper blade 13 and the downstream side wiper blade 16 as the plurality of wiper blades.

Then, as represented by FIG. 9, the downstream side wiper blade 16 is arranged with regard to the upstream side wiper blade 13 to be spaced with a gap L13 which is equal to or more than a length L12 of the upstream side wiper blade 13 in the movement direction D1 when the transfer belt 2 is moved in the movement direction D1.

As a result, in the recording apparatus 1 of the present embodiment, it is possible to remove the cleaning fluid 14 using the downstream side wiper blade 16 when movement of the transfer belt 2 is resumed, even though the cleaning fluid 14 remains in the region on the support surface S when the transfer belt 2 is stopped, in the same manner as the recording apparatus 1 of the first embodiment. Accordingly, the cleaning fluid 14 remaining on the transfer belt 2 and the recording medium P being unclean due to the cleaning fluid 14 are effectively suppressed.

Figure 11:
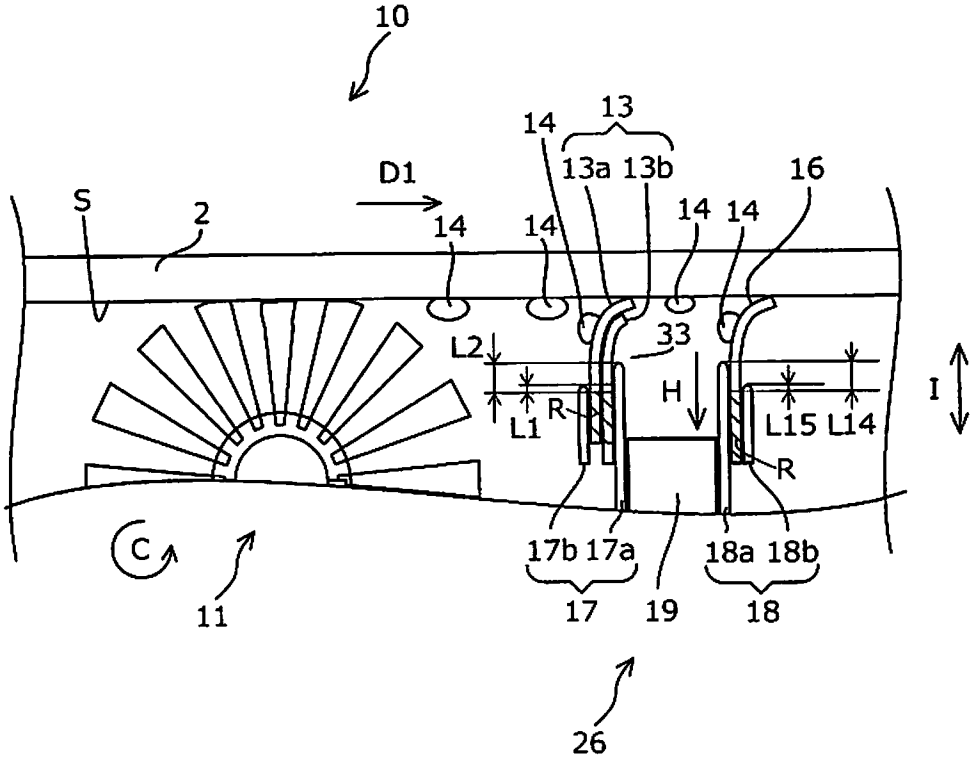
FIG. 11 is an outline diagram representing a side surface of a cleaning unit of a recording apparatus according to the third embodiment of the present invention and representing a state in which a transfer belt moves in a movement direction when a recording medium is transferred in the cleaning unit during recording.

Third Embodiment (FIG. 11)

Next, a recording apparatus of the third embodiment will be described in detail with reference to the attached drawings.

FIG. 11 is an outline diagram representing a side surface of the cleaning unit 10 of the recording apparatus 1 of the present embodiment and representing a state of the cleaning unit 10 where the transfer belt 2 moves in the movement direction D1 when the recording medium P is transferred during recording. Here, configuring members which are common with the embodiment described above are shown with the same symbols and detailed description thereof is omitted.

Here, the cleaning unit 10 of the present embodiment has the same configuration as the cleaning unit 10 of the first embodiment except for, among the wiper blades 13 and 16 which are clamped by the clamping members 17 and 18, the extension length of the clamping member 18 on the upstream side in the movement direction D1 being longer for the wiper blade 16.

In the recording apparatus 1 of the first embodiment, the extension lengths of the clamping members 17 and 18 on the downstream side in the movement direction D1 are longer in both of the wiper blades 13 and 16 which are clamped by the clamping members 17 and 18.

On the other hand, in the recording apparatus 1 of the present embodiment, the extension length of the clamping members 17 on the downstream side in the movement direction D1 is longer in only the wiper blade 13 among the wiper blades 13 and 16 which are clamped by the clamping members 17 and 18. That is, in the same manner as the clamping members 17 of the recording apparatus 1 of the first embodiment, the extension lengths of the clamping members 17 (the extension length L1 of the upstream side clamping member 17*b* and the extension length L2 of the downstream side clamping member 17*a*), which are from the clamping region R in the direction of the transfer belt 2, are different depending on the clamping member 17, and the extension length L2, which is on the downstream side in the movement direction A of the transfer belt 2 to accompany transfer of the recording medium P during recording, is longer out of the extension lengths L1 and L2. However, the extension lengths of the clamping members 18 (an extension length L14 of the upstream side clamping member 18*a* and an extension length L15 of the downstream side clamping member 18*b*), which are from the clamping region R in the direction of the transfer belt 2, are different depending on the clamping member 18, and the extension length L14, which is the upstream side of the transfer belt 2 in the movement direction A to accompany transfer of the recording medium P during recording, is longer out of the extension lengths L10 and L11.

As in the recording apparatus 1 of the present embodiment, it is sufficient if the extension lengths of the clamping members 17 and 18 on the downstream side in the movement direction D1 are longer in at least one of the plurality of wiper blades.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A recording apparatus comprising:

a transfer belt configured and arranged to transfer a recording medium;

a recording section configured and arranged to perform recording on the recording medium;

a wiper blade configured and arranged to abut with the transfer belt; and a pair of clamping members supporting the wiper blade as being clamped by the clamping members, an extension length from an clamping region toward the transfer belt of one of the clamping members on a downstream side with respect to a movement direction of the transfer belt transferring the recording medium in recording being longer than the extension length of the other of the clamping members, when the transfer belt is moved in an opposite direction to the movement direction, the wiper blade bending with the other of the clamping members on an upstream side as an origin.

2. The recording apparatus according to claim 1, wherein the clamping members have rigidity equal to or more than the wiper blade.

3. The recording apparatus according to claim 1, wherein the clamping members are elastic members.

4. The recording apparatus according to claim 1, further comprising an additional wiper blade, and an additional pair of clamping members supporting the additional wiper blade as being clamped by the additional clamping members.

5. The recording apparatus according to claim 1, wherein the clamping members clamp the wiper blade including a plurality of blades.

6. The recording apparatus according to claim 5, wherein the plurality of blades includes an upstream side wiper blade on an upstream side and a downstream side wiper blade on the downstream side, and the downstream side wiper blade is arranged with respect to the upstream side wiper blade to be spaced with a gap which is equal to or more than a length of the upstream side wiper blade in the movement direction when the transfer belt is moved in the movement direction.

7. A recording apparatus comprising:

a transfer belt configured and arranged to transfer a recording medium;

a recording section configured and arranged to perform recording on the recording medium;

a wiper blade configured and arranged to abut with the transfer belt; and a pair of clamping members supporting the wiper blade as being clamped by the clamping members, an extension length from an clamping region toward the transfer belt of one of the clamping members on a downstream side with respect to a movement direction of the transfer belt transferring the recording medium in recording being longer than the extension length of the other of the clamping members, the transfer belt including a support surface on which the recording medium is supported, and the wiper blade being more hydrophilic than the support surface.

8. A recording apparatus comprising:

a transfer belt configured and arranged to transfer a recording medium;

a recording section configured and arranged to perform recording on the recording medium;

a wiper blade configured and arranged to abut with the transfer belt; and a pair of clamping members supporting the wiper blade as being clamped by the clamping members, an extension length from an clamping region toward the transfer belt of one of the clamping members on a downstream side with respect to a movement direction of the transfer belt transferring the recording medium in recording being longer than the extension length of the other of the clamping members, at least one of the clamping members having a groove on a side facing the wiper blade.

9. A recording apparatus comprising:

a transfer belt configured and arranged to support and transfer a recording medium on a support surface; and a wiper blade configured and arranged to abut with the transfer belt, the wiper blade being configured to bend more when the transfer belt is moved in an opposite direction to a movement direction than when the transfer belt is moved in the movement direction to transfer the recording medium in recording.

* * * * *